US011013954B2

(12) United States Patent
Schwarz

(10) Patent No.: US 11,013,954 B2
(45) Date of Patent: May 25, 2021

(54) STATIONARY SLED EXERCISE MACHINE

(71) Applicant: Magic by Magic, Inc., Austin, TX (US)

(72) Inventor: Magic Schwarz, Austin, TX (US)

(73) Assignee: MAGIC BY MAGIC, INC., Austin, TX (US)

( * ) Notice: Subject to any disclaimer, the term of this patent is extended or adjusted under 35 U.S.C. 154(b) by 34 days.

(21) Appl. No.: 16/459,945

(22) Filed: Jul. 2, 2019

(65) Prior Publication Data

US 2020/0001130 A1 Jan. 2, 2020

Related U.S. Application Data

(60) Provisional application No. 62/693,155, filed on Jul. 2, 2018.

(51) Int. Cl.

| | |
|---|---|
| ***A63B 22/20*** | (2006.01) |
| ***A63B 21/00*** | (2006.01) |
| ***A63B 21/02*** | (2006.01) |
| ***A63B 21/055*** | (2006.01) |
| ***A63B 21/04*** | (2006.01) |

(52) U.S. Cl.

CPC ..... *A63B 22/203* (2013.01); *A63B 21/023* (2013.01); *A63B 21/0428* (2013.01); *A63B 21/0552* (2013.01); *A63B 21/4015* (2015.10); *A63B 21/4029* (2015.10); *A63B 21/4034* (2015.10); *A63B 21/4035* (2015.10); *A63B 2208/0295* (2013.01)

(58) Field of Classification Search

CPC ..... A63B 22/203; A63B 22/201; A63B 22/20; A63B 22/205; A63B 22/208; A63B 22/0087; A63B 22/0089; A63B 23/03541; A63B 23/0417; A63B 23/047; A63B 21/4015; A63B 21/4029; A63B 21/4034; A63B 21/4035; A63B 21/023; A63B 21/0428; A63B 21/0552

USPC ..... 482/123, 129, 70

See application file for complete search history.

(56) References Cited

U.S. PATENT DOCUMENTS

| | | | | | |
|---|---|---|---|---|---|
| 1,866,868 | A * | 7/1932 | Hardy | A63B 22/0076 | 482/72 |
| 2,720,396 | A * | 10/1955 | Pfaus | A63B 23/0417 | 482/130 |
| 3,309,084 | A * | 3/1967 | Simmons | A63B 22/0005 | 482/62 |

(Continued)

*Primary Examiner* — Gary D Urbiel Goldner
*Assistant Examiner* — Thao N Do
(74) *Attorney, Agent, or Firm* — Hall Estill Attorneys at Law

(57) ABSTRACT

An exercise machine to facilitate a leg extension exercise by a user. A rigid frame supports a pair of spaced-apart guide rails. A foot plate assembly is adapted to move along the guide rails and includes a foot support surface at a selected angle to support a sole of a foot of the user. A wing flange extends upwardly along an inner side of the foot support surface to align the foot during extension and retraction of the foot plate assembly along the guide rails. Rollers are arranged along each side of the guide rails to support the foot plate assembly. The rollers are arranged into sets of at least three rollers including two upper rollers and at least one lower roller in a triangular configuration. At least one of the lower rollers is offset horizontally from and disposed between the at least two of the upper rollers.

23 Claims, 8 Drawing Sheets

(56) References Cited

U.S. PATENT DOCUMENTS 3,707,284 A * 12/1972 Waldeck ..... A63B 21/023 482/130
3,749,400 A * 7/1973 Stoffel ..... A63B 21/1609 482/123
3,759,511 A * 9/1973 Zinkin ..... A63B 21/00069 482/51
4,229,001 A * 10/1980 Roman ..... A63B 21/012 482/114
4,402,506 A * 9/1983 Jones ..... A63B 22/0012 273/DIG. 8
4,550,908 A * 11/1985 Dixon ..... A63B 21/00181 482/111
4,684,121 A * 8/1987 Nestegard ..... A63B 21/4047 482/70
4,695,050 A 9/1987 Smith et al.
4,733,858 A * 3/1988 Lan ..... A63B 23/1209 482/113
4,781,372 A * 11/1988 McCormack .... A63B 23/03533 482/104
4,979,731 A * 12/1990 Hermelin ..... A63B 22/001 482/51
5,209,711 A * 5/1993 Scrima ..... A61H 1/0244 482/51
5,221,242 A 6/1993 Weber et al.
5,222,928 A * 6/1993 Yacullo ..... A63B 21/023 482/51
5,279,530 A 1/1994 Hess
5,499,958 A * 3/1996 Hess ..... A63B 21/0552 482/123
5,520,598 A * 5/1996 Little ..... A63B 21/0615 482/51
5,549,529 A 8/1996 Rasmussen
5,582,567 A * 12/1996 Chang ..... A63B 22/16 482/132
5,941,800 A * 8/1999 Laconis ..... A63B 69/18 482/70
6,042,523 A * 3/2000 Graham ..... A63B 21/0552 482/121
6,149,554 A * 11/2000 Ferguson ..... A63B 21/023 482/83
6,165,107 A * 12/2000 Birrell ..... A63B 21/157 482/51
6,186,929 B1 * 2/2001 Endelman ..... A63B 21/154 482/121
6,440,042 B2 8/2002 Eschenbach
6,942,585 B1 * 9/2005 Krause ..... A63B 69/002 473/445
7,594,877 B2 * 9/2009 Anderson ..... A63B 21/154 482/51
7,637,848 B1 * 12/2009 Chang ..... A63B 22/001 482/51
7,803,095 B1 * 9/2010 LaGree ..... A63B 22/0012 482/140
8,641,585 B2 2/2014 LaGree
9,630,056 B2 * 4/2017 Rao ..... A63B 23/0222
2001/0056011 A1 * 12/2001 Endelman ..... A63B 22/0087 482/121
2003/0195095 A1 * 10/2003 Endelman ..... A63B 22/0089 482/142
2004/0167000 A1 * 8/2004 Schwarz ..... A63B 23/03541 482/123
2008/0032869 A1 * 2/2008 Pacheco ..... A63B 21/157 482/52
2010/0004101 A1 * 1/2010 Solow ..... A63B 22/203 482/96
2011/0082015 A1 * 4/2011 Dreissigacker .... A63B 21/0088 482/72
2011/0152036 A1 * 6/2011 Halver ..... A63B 22/0046 482/51
2011/0294633 A1 * 12/2011 Esrick ..... A63B 21/0552 482/139
2012/0157244 A1 * 6/2012 Staten ..... A63B 21/0004 473/445
2013/0085048 A1 * 4/2013 Na ..... A63B 21/4049 482/142
2013/0217551 A1 * 8/2013 Parnell ..... A63B 21/0557 482/141
2014/0024480 A1 * 1/2014 George ..... A63B 23/047 473/445
2015/0165265 A1 * 6/2015 Tholkes ..... A63B 23/03566 482/54
2015/0202484 A1 * 7/2015 Lalaoua ..... A63B 23/03541 482/127
2017/0136295 A1 * 5/2017 Tholkes ..... A61B 5/0488

* cited by examiner

STATIONARY SLED EXERCISE MACHINE

RELATED APPLICATIONS

The present application makes a claim of domestic priority under 35 U.S.C. 119(e) to U.S. Provisional Patent Application No. 62/693,155 filed Jul. 2, 2018, the contents of which are hereby incorporated by reference.

BACKGROUND

A number of exercise machines have been proposed in the art to facilitate exercise training of a human body. Such machines can use free weights, plates, resistance members (e.g., springs, bands), the body weight of the user, etc., in order to supply resistance to movement along a selected path to safely strengthen one or more muscle groups.

United States Published Patent Application No. 2004/0167000 discloses a leg exercise type machine invented by the inventor of the present application. The published '000 application generally provides a stationary sled exercise machine in which a user reciprocally advances and retracts the legs while leaning forward into a shoulder rest assembly to support the upper torso of the user. Unlike portable sleds which are designed to be pushed along a floor surface as the users take alternating, large extended and retracted strides, the stationary sled has foot mount guides that alternately advance and retract along rails against resistance supplied by a spring or other resistance member.

While operable, several patentably distinct improvements have been generated by the present inventor since the time of the filing of the '000 patent application, and it is to such improvements that the present application is directed.

SUMMARY

Various embodiments of the present disclosure are generally directed to an exercise machine to permit a user to perform a leg extension exercise. In some embodiments, a rigid frame supports a pair of spaced-apart guide rails. A foot plate assembly is adapted to move along the guide rails and includes a foot support surface at a selected angle to support a sole of a foot of the user. A wing flange extends upwardly along an inner side of the foot support surface to align the foot during extension and retraction of the foot plate assembly along the guide rails. Rollers are arranged along each side of the guide rails to support the foot plate assembly. The rollers are arranged into sets of at least three rollers including two upper rollers and at least one lower roller in a triangular configuration. At least one of the lower rollers is offset horizontally from and disposed between the at least two of the upper rollers.

These and other features and advantages of various embodiments can be understood from a review of the following detailed description in conjunction with the accompanying drawings.

DETAILED DESCRIPTION

Figure 1:
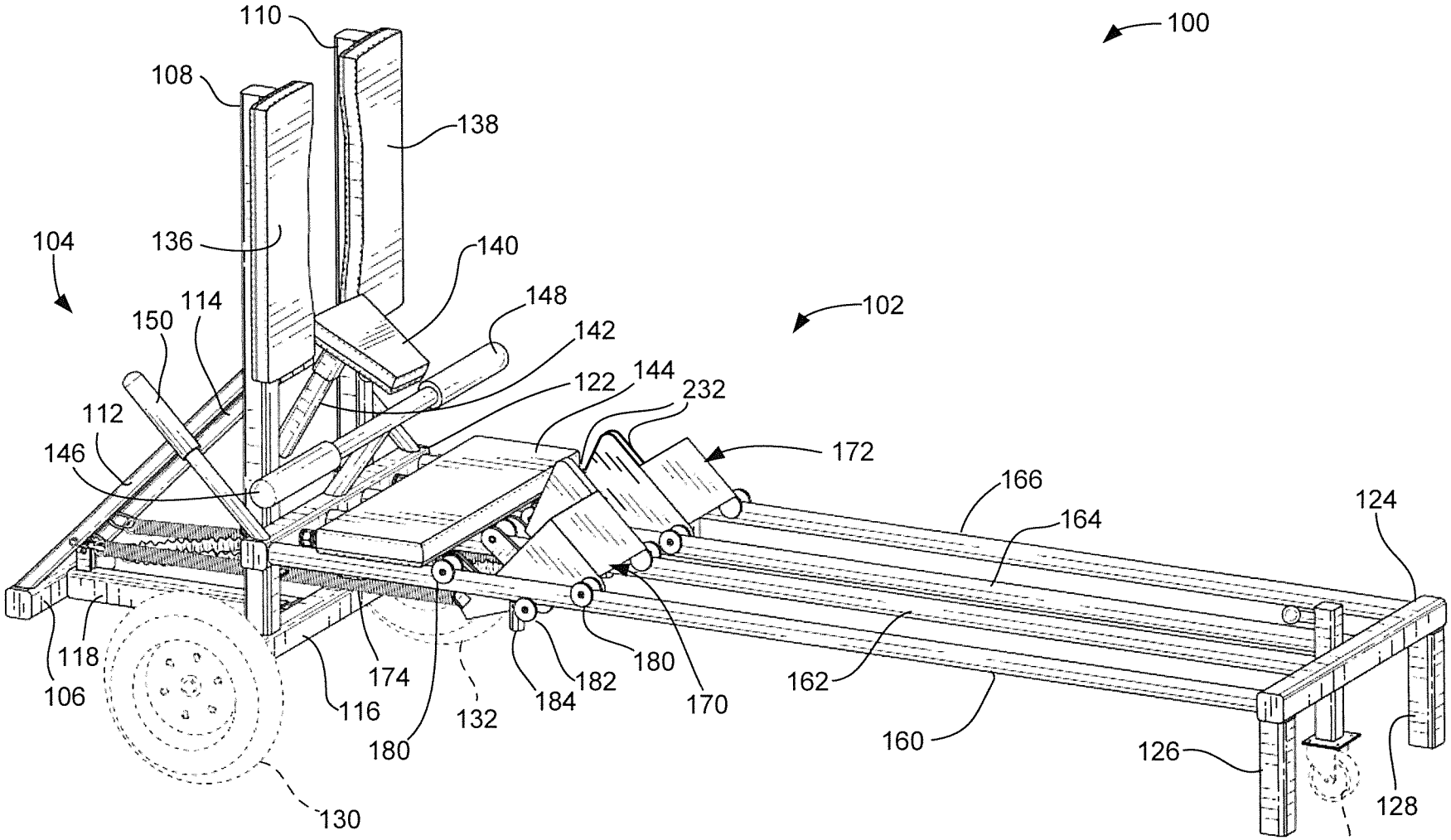
FIG. 1 shows an isometric depiction of an exercise machine system constructed and operated in accordance with various embodiments of the present disclosure.

Various embodiments of the present disclosure are generally directed to a system for exercising a human body. The system takes the form of a stationary sled exercise machine in which the user performs leg press/extensions against one or more moveable foot plates.

As explained below, various embodiments include a substantially rectilinear open frame configured for placement on a base (floor) surface. A user support assembly is positioned at one end of the frame with various surfaces configured to support the upper torso of the user.

As set forth by at least some embodiments, two pairs of parallel guide rails extend along the length of the frame and are sized and spaced to nominally align with each leg of the user. A corresponding pair of foot plate assemblies are affixed to the guide rails, with each foot plate assembly spanning an associated pair of the guide rails for linear movement therealong. Each foot plate assembly has a foot plate adapted to contactingly engage the sole of a shoe of the user. A textured coating or other feature may be applied to the foot plate to ensure consistent contact is maintained between the shoe and the plate.

A side flange (wing) extends along the inside of each foot plate to contactingly support an inside of each shoe, and a toe flange extends from the front of each foot plate to contactingly support the toe of each shoe. Further retention members such as a low-slip textured surface, a toe cover and/or interlocking treads can be used to enhance and maintain contact between the respective shoes and foot plates.

Each guide rail may include upper and lower convex (e.g., cylindrically shaped) track surfaces. Each foot plate assembly includes upper and lower concave rollers configured to roll along and be retained upon the associated guide rail. In some embodiments, six (6) rollers are attached to each foot plate assembly, with two upper rollers and one lower roller arranged in a triangular pattern on each side to couple each foot plate assembly to the respective pair of guide rails. The lower rollers may be nominally aligned with the ball of the user's foot to provide enhanced stability during extension of the foot plate assembly.

One or more resistance members are attached to a front bracket and extend backwards to a front attachment point of each foot plate assembly. The user exerts a force to extend the foot plate assembly away from the shoulder rest, and this force is resisted by the linear response of the resistance member. Each foot plate assembly can be moved independently.

The resistance members can take the form of coiled springs. Other forms of resistance members can be used such as elastomeric bands, cables, etc. In some cases, multiple resistance members may be coupled to each foot plate assembly. When springs are used, covers may be supplied to reduce pinch points between adjacent coils.

The resistance members may be routed as required including inside one or more of the guide rails. The resistance members are readily removable and replaceable to provide different levels of force for different active ranges. The resistance members may be color coded or provided with other visually detectable indicia to indicate the various force ranges.

Other features can include curvilinearly extending shoulder rests and other padded areas, specially configured handlebars that can be grasped by the hands of the user, etc. At least some embodiments have generally forward extending frame members to enhance stability of the system. Each of the frame members can be formed of curved hollow or solid tubing.

A forward cross member (bar) can be used to support a securement position to secure distal ends of the resistance members. Wheels can be attached to the frame to enable movement of the exercise machine to a desired location when use. Other embodiments are contemplated such as a foldable frame to enhance storability of the system when not in use.

Figure 2A:
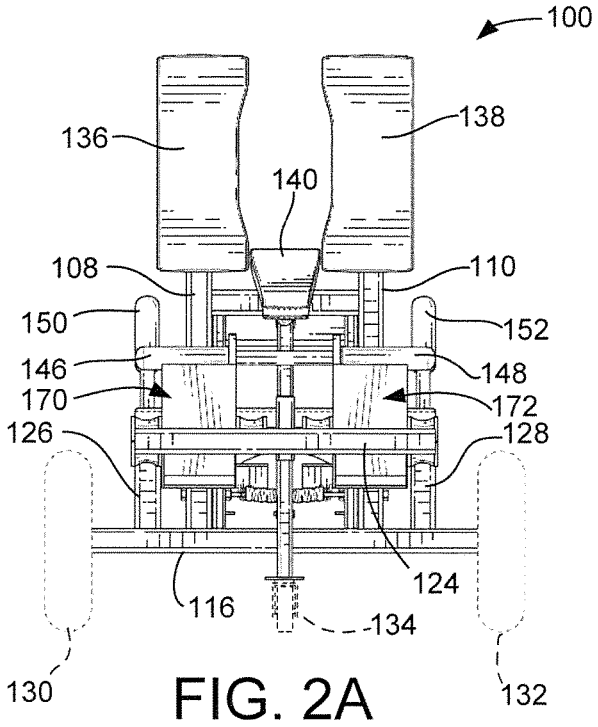
FIGS. 2A and 2B show respective rear and front views of the system.
Figure 2B:
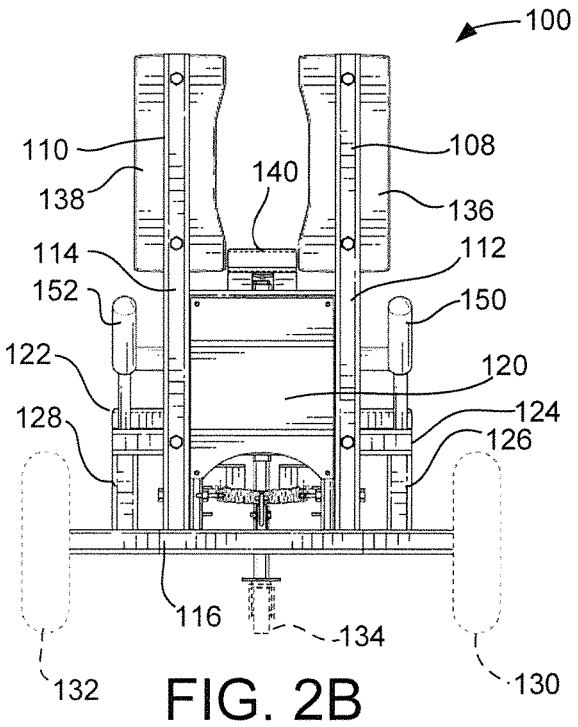
Figure 3:
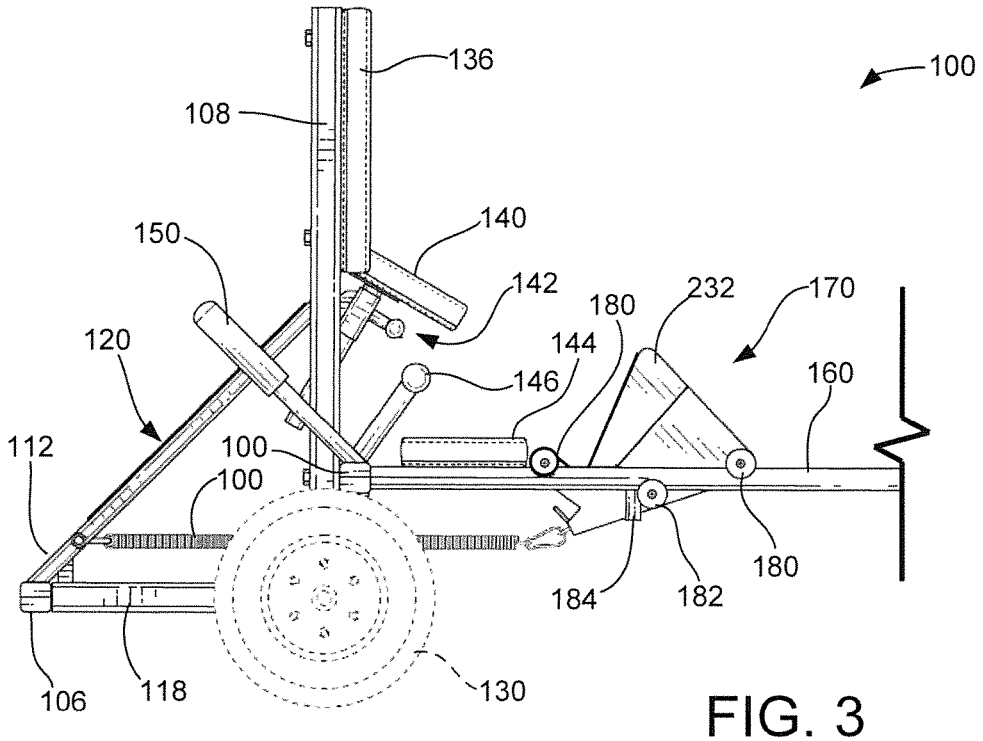
FIG. 3 is a side elevational truncated view of the system.
Figure 4A:
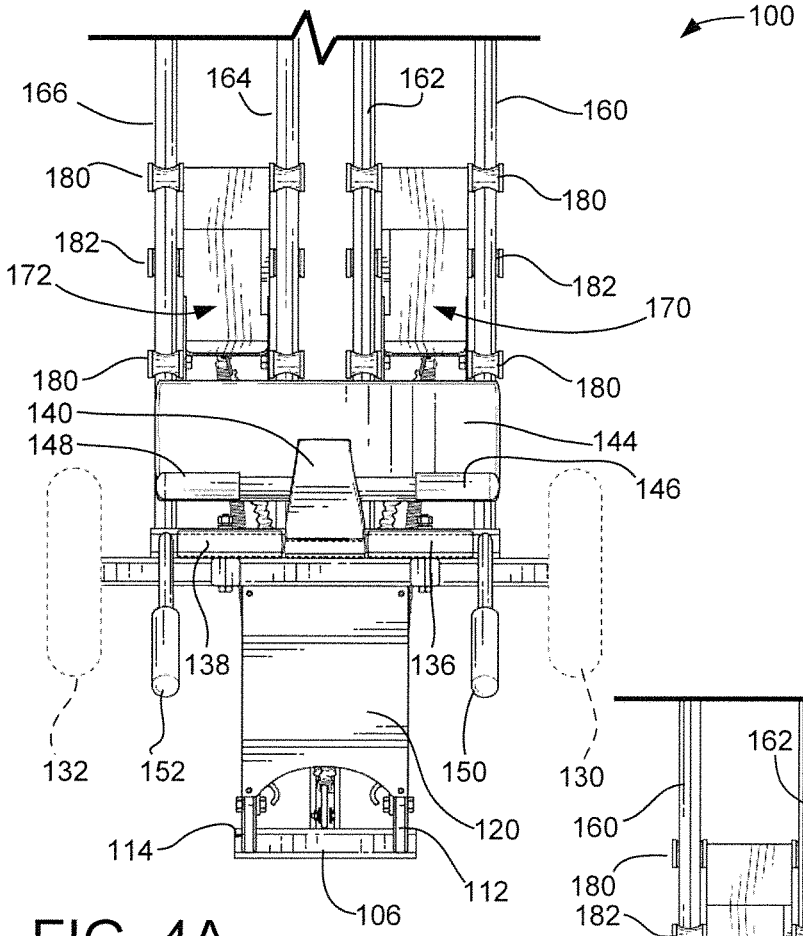
FIGS. 4A and 4B are respective top and bottom truncated views of the system.
Figure 4B:
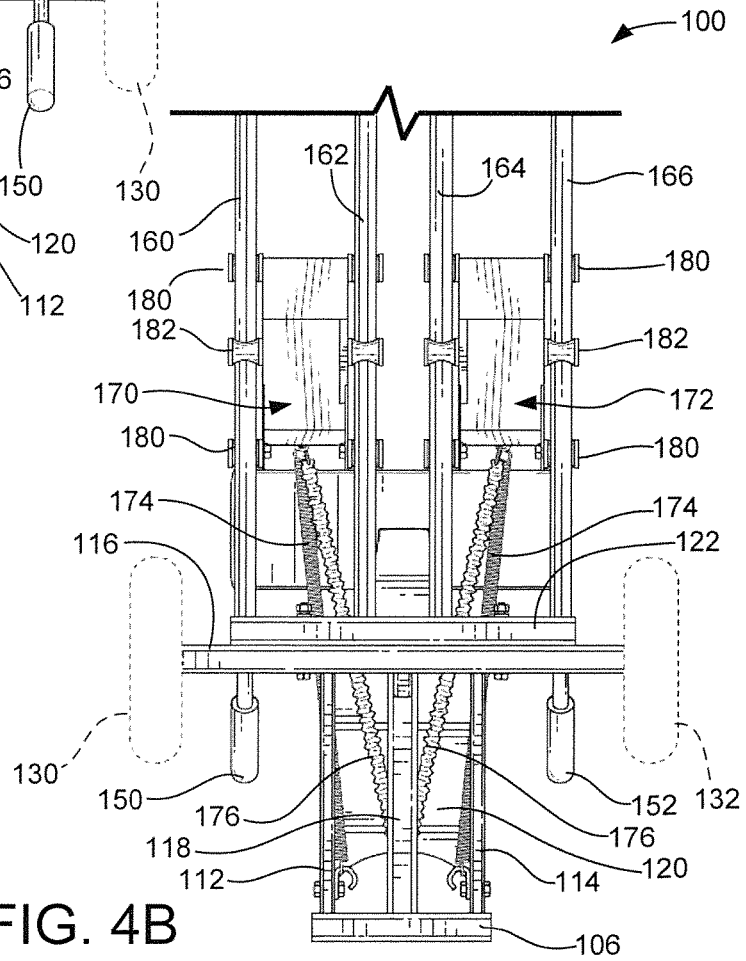

These and other features and advantages of various embodiments can be understood beginning with a review of FIG. 1 which provides an isometric representation of an exercise machine 100. FIGS. 2A and 2B provide respective front and rear views of the machine 100. FIG. 3 shows a (truncated) side elevational view, and FIGS. 4A and 4B show respective (truncated) top and bottom views.

For purposes of the following discussion, the term longitudinal and the like will describe a direction along the length (longest dimension) of the machine, and the term lateral and the like will describe a direction across the width of the machine. Similarly, terms such as horizontal and vertical will apply to the machine in its normal orientation at rest on a base surface during use.

As noted above, the machine 100 is characterized as a stationary sled type exercise device. The system includes a rigid frame 102 formed of a number of tubular solid and/or hollow elongated metal frame members 104. The frame members 104 may be attached in any suitable fashion such as via welding, threaded fasteners, etc.

The frame members 104 include a laterally extending front cross bar 106, vertically extending cushion support posts 108, 110, and angled support bars 112, 114. A central base member 116 extends laterally to adjoin and support the two vertically extending support posts 108, 110. A longitudinally extending center bar member 118 extends from a center of the base member 116 to a center of the front cross bar 106 in a general t-bar fashion.

The angled support bars 112, 114 extend in parallel fashion from each end of the horizontal front cross bar 106 to the vertical support posts 108, 110. The angled support bars 112, 114 are best viewed in FIG. 3 and FIGS. 4A-4B and can extend at any suitable bracing angle such as from about 30 degrees to about 60 degrees. A protective cover plate 120 spans the top sides of the angled support bars 112, 114 to cover the resistance members (discussed below). An intermediate support member (cross bar) 122 extends laterally and parallel to the central base member 116 to lend further structural support to the frame 102, as well as to support other members of interest.

At this point it will be noted that all of these frame members are disposed at a front, or proximal, end of the machine 100. Additional frame members are located at a rear, or distal end of the machine. These frame members include a laterally extending rear cross bar 124, and vertically extending legs 126, 128.

As desired, an optional pair of front wheels 130, 132 and a deployable/retractable rear castor wheel 134 can be respectively used to enable movement of the system 100 to a desired location. Other arrangements can be used, however, including configurations without such wheels, in which case additional legs can be used to support the front portion of the system.

The vertically extending posts 108, 110 support respective left and right shoulder pads (cushions) 136, 138. These cushions, as well as other cushions of the machine, can be formed of an interior foam or other elastomeric material with a tough and durable exterior coating or upholstery layer. An adjustable chest pad 140 is articulated using adjustment member 142 to a desired position and angle between the shoulder pads 136, 138 to support the center of the chest (sternum area) of the user. A laterally extending knee pad is shown at 144 and serves to provide a cushioned surface for the knees of the user when the user mounts and dismounts from the machine.

A first pair of laterally extending handle bars have left and right side cushioned user grips 146, 148. A second pair of handle bars (best viewed in FIGS. 3 and 4A) have left and right side cushioned grips 150, 152 that extend forward as shown. Both sets of handle bars are supported by the intermediate cross bar 122. The user can position the upper torso in contact against the various pads 136, 138, 140 with the head of the user extending between the shoulder pads and the hands of the user grasping the desired set of user grips.

Longitudinally extending guide rails 160, 162, 164 and 166 are supported by the frame 102. Proximal ends of the guide rails are affixed to and supported by the front cross bar 122, and distal ends of the guide rails are affixed to and supported by the rear cross bar 124. The guide rails are arranged in pairs, with the left side guide rails 160, 162 supporting a left side (or "first") foot plate assembly 170, and the right side guide rails 164, 166 supporting a right side (or "second") foot plate assembly 172.

The construction and operation of the respective foot plate assemblies 170 and 172 will be discussed in detail below. At this point it will be appreciated that each of the foot plate assemblies 170, 172 is configured to support a different foot of the user and to be alternately extended and retracted by the associated leg of the user along the associated pair of the guide rails using a typical "squat" or "leg extension" type movement. Resistance to this reciprocal and alternating movement of the foot plate assemblies is provided by one or more resistance members.

As best viewed in the bottom view of FIG. 4B, these resistance members can include coiled springs 174 and elastomeric straps 176. The various resistance members are configured to be removed and replaced as desired to set an appropriate resistance level for the user. To this end, the knee pad 144 may be hinged to allow the edge of the pad closest to the foot plate assemblies 170, 172 to be raised, thereby enabling the user easy access to connect the resistance members to the foot plate assemblies. With reference again to FIG. 4A, the cover plate 120 has a cutout region (not numerically designated) to similarly allow access by the user to connect the resistance members to the frame 102.

It will be appreciated that both coiled springs and straps need not be used at the same time; other configurations can use any number or combination of either of these types of resistance members, as well as other forms of resistance members. For example, cables could be routed to one or more stacks of plates mounted to the front of the machine that are then lifted by the user. Different resistance members with different resistance forces can be supplied and installed by the user as desired to provide different levels of resistance during exercising. While alternating movement using both legs is contemplated, such is not necessarily required; there are situations where the user may use only a single one of the foot plate assemblies to exercise a single leg, etc.

Each of the foot plate assemblies 170, 172 is supported by a total of six (6) rollers. These are arranged as respective upper rollers 180 and lower rollers 182. Two upper rollers 180 and one lower roller 182 is affixed to each side of each foot plate assembly in a triangular arrangement. Limit stops such as 184 (see FIGS. 1 and 3) may extend from at least some of the guide rails 160, 162, 164 and 166 to serve as an inner limit for movement of the respective foot plate assemblies 170, 172. Other numbers of rollers may be used, including different respective numbers of rollers on each side of each foot plate assembly.

Figure 5:
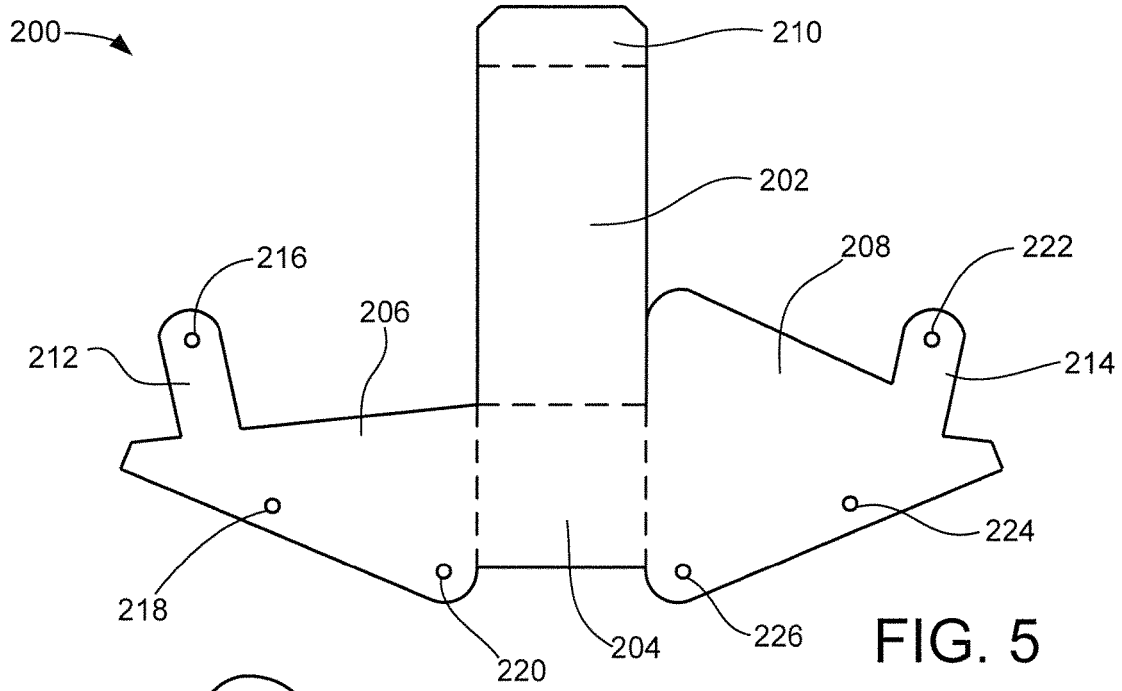
FIG. 5 shows a sheet metal pattern that can be used to form the respective foot plate assemblies of the system.

Having now concluded an overview of the machine 100, the foot plate assemblies 170, 172 will now be discussed in greater detail beginning with reference to FIG. 5, which shows a flat pattern 200 from which the respective foot plate assemblies may be assembled in some embodiments. The flat pattern 200 constitutes a suitable bendable material such as sheet metal cut into the indicated shape. Other construction methods and materials can be used, such as but not limited to ABS plastic, injection molding, machining, etc.

The pattern 200 includes a number of panels, including a foot plate panel 202, a rear support panel 204, an outer side panel 206, an inner side panel 208, and a foot rest panel 210. The outer side panel 206 includes a projecting support ear 212, and the inner side panel 208 has a similar projecting support ear 214. Respective through-hole apertures are provided at 216, 218, 220 in the outer side panel 206, and at 222, 224 and 226 in the inner side panel 208. These apertures accommodate fasteners to support the various rollers discussed above. While the apertures are depicted as circular, other shapes can be used such as oval shapes to accommodate manufacturing tolerances, square shapes to accommodate carriage bolts, etc.

The dotted lines indicate fold lines along which nominally 90 degree bends (breaks) can be formed using a suitable press break machine or other equipment. The various seams can be affixed via welding or other attachment mechanisms. Both the left and right side foot plate assemblies 170, 172 can be formed by applying different directions of the breaks to the same pattern 200.

Figure 6:
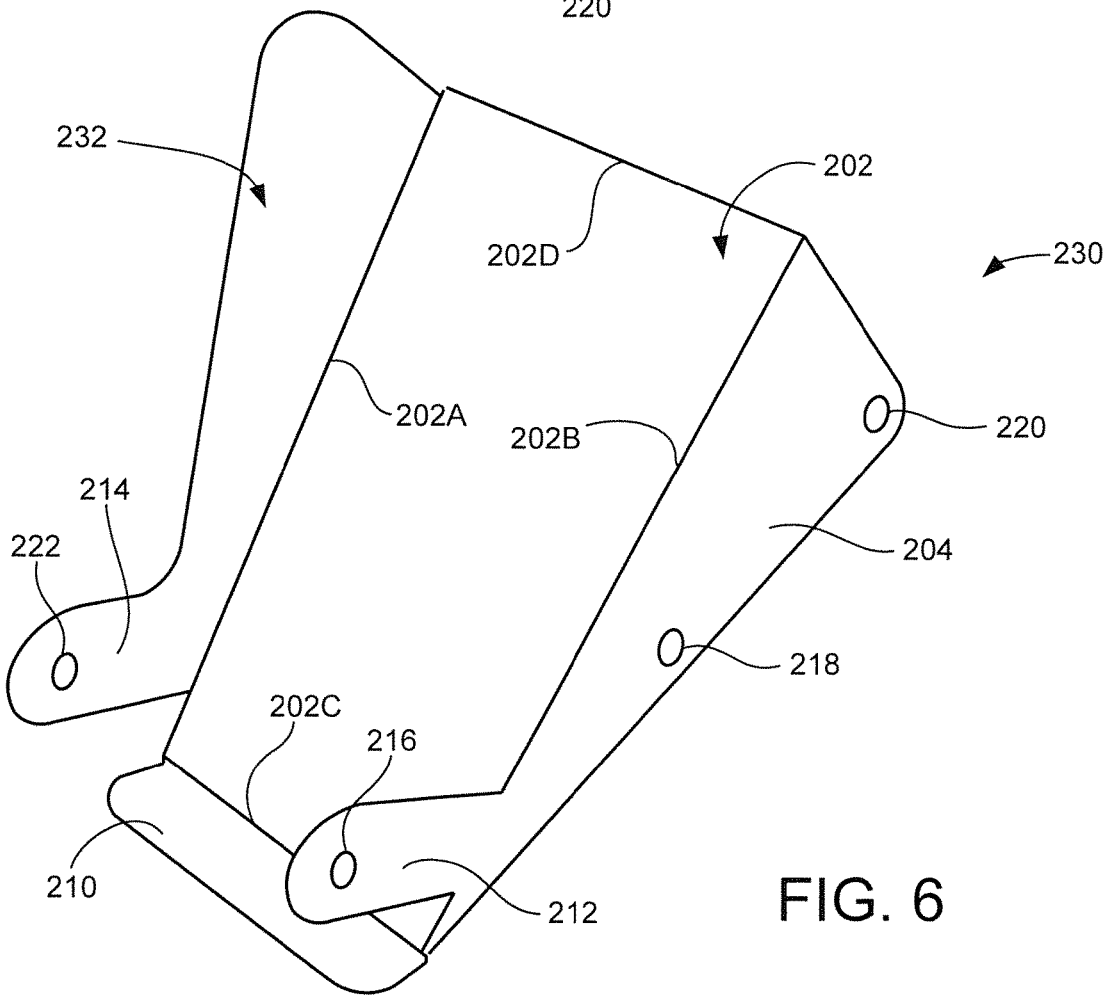
FIG. 6 is an isometric depiction of a foot plate portion formed from the pattern of FIG. 5.

FIG. 6 shows an assembled left side foot plate 230 that corresponds to, and that can be incorporated into, the left side foot plate assembly 170 in FIG. 1. The foot plate 230 is formed from the pattern 200 in FIG. 5. A right side foot plate corresponding to and incorporated into the right side foot plate assembly 172 of FIG. 1 can be formed in similar fashion.

The foot plate panel 202, also sometimes referred to as a foot support or foot support surface, is configured to support the foot of the user during operation (albeit not necessarily directly, as the user will likely wear a shoe during exercising although such is not necessarily required). The panel 202 extends at a selected obtuse angle with respect to the rails, such as but not limited to a range of from about 120 to about 160 degrees with respect to horizontal. The various embodiments show an angle of about 135 degrees (e.g., an interior angle of about 45 degrees from horizontal).

The panel 202 is substantially rectangular, although other suitable shapes can be used as desired. Generally, the panel 202 has an inner side 202A configured for alignment along an inner surface of the foot, an opposing outer side 202B configured for alignment along an outer surface of the foot, a front edge 202C configured for alignment adjacent a toe of the foot, and a back edge 202D configured for alignment adjacent a heel of the foot.

A portion of the inner side panel 208 extends upwardly above the foot plate panel 202 along the inner side 202 thereof to provide an inner side support flange 232, also referred to as a "wing" or a "wing flange." The wing 232 provides an inner side contact surface to help stabilize the inside of the foot of the user. As used herein, reference to the inside surface or inside of the foot of the user, or the like, will be understood to describe that side of the foot that is in closest proximity to the midpoint or center of the body of the user, e.g., the side of the foot that is normally closer to the other foot of the user, the side of the foot along which the big toe extends, etc. This arrangement is readily apparent from FIG. 1; the two wings 232 on the respective foot plate assemblies 170, 172 are arranged to be immediately adjacent each other along the longitudinal interior center of the machine.

It was found during development of the present embodiments that many users tended to rotate their heels inwardly during use of the machine. The wings 232 help keep the stride of the user straight by preventing such rotation of the feet. If the feet are straight, the legs will also be straight as well. The wings 232 thus aid the user in maintaining proper stride form, enhancing the effectiveness of the exercise and reducing the potential for strain or injury.

At this point it will be noted that a corresponding outer wing on the outside of the foot is not provided in the embodiment of FIG. 1 (the outside of the foot will be understood to be the opposite side of the inside of the foot as described above). While an outer wing similar to the inner wing 232 could be provided in some embodiments, such would be unnecessary, as well as make it more difficult for the user to place their feet onto the respective foot support surfaces 202 of the foot plate assemblies 170, 172. Stated another way, the nominally 90 degree bend between the vertically aligned outer side panel 206 and the angled shoe surface panel 202 makes it easy for the user to place the foot onto the surface without obstruction. However, as desired, a small outer lip surface can be provided along the boundary between panels 202 and 206.

An anti-slip textured material can be applied to the foot support surface 202 to increase the friction between the sole of the shoe and the surface 202 to reduce slippage during use. A thin cushioning layer of elastomeric material can be applied to the wing 232 (as well as to other aspects of the foot plate 230, such as the toe flange 210, the ears 212, 214, etc.) to increase comfort and reduce marring.

Figure 7A:
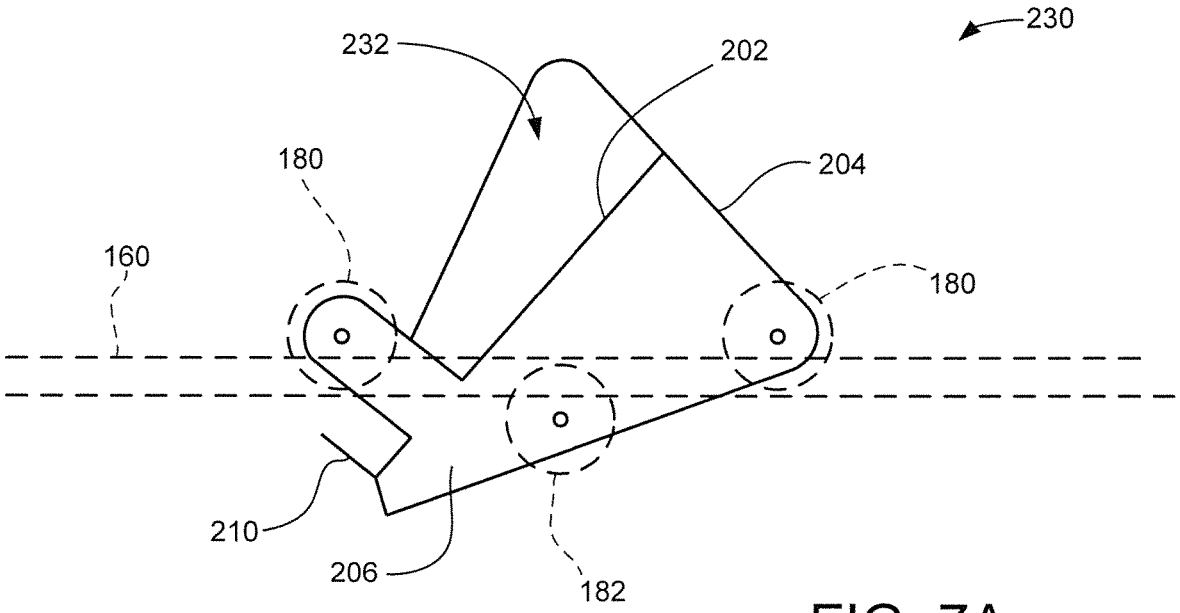
FIGS. 7A and 7B are respective left side and right side schematic views of the foot plate portion of FIG. 6 in some embodiments.
Figure 7B:
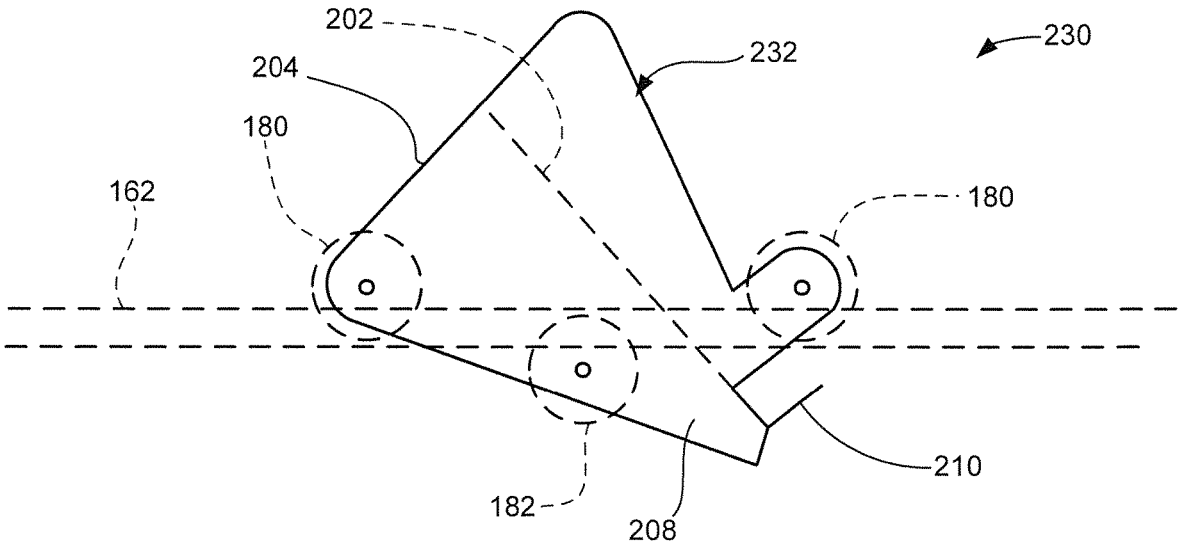

FIGS. 7A and 7B show the foot plate 230 as generally installed as the left foot plate assembly 170 in FIG. 1. FIG. 7A shows the outside (left) view and FIG. 7B shows the inside (right) view. These features are mirrored for the right foot plate assembly 172.

Figure 8:
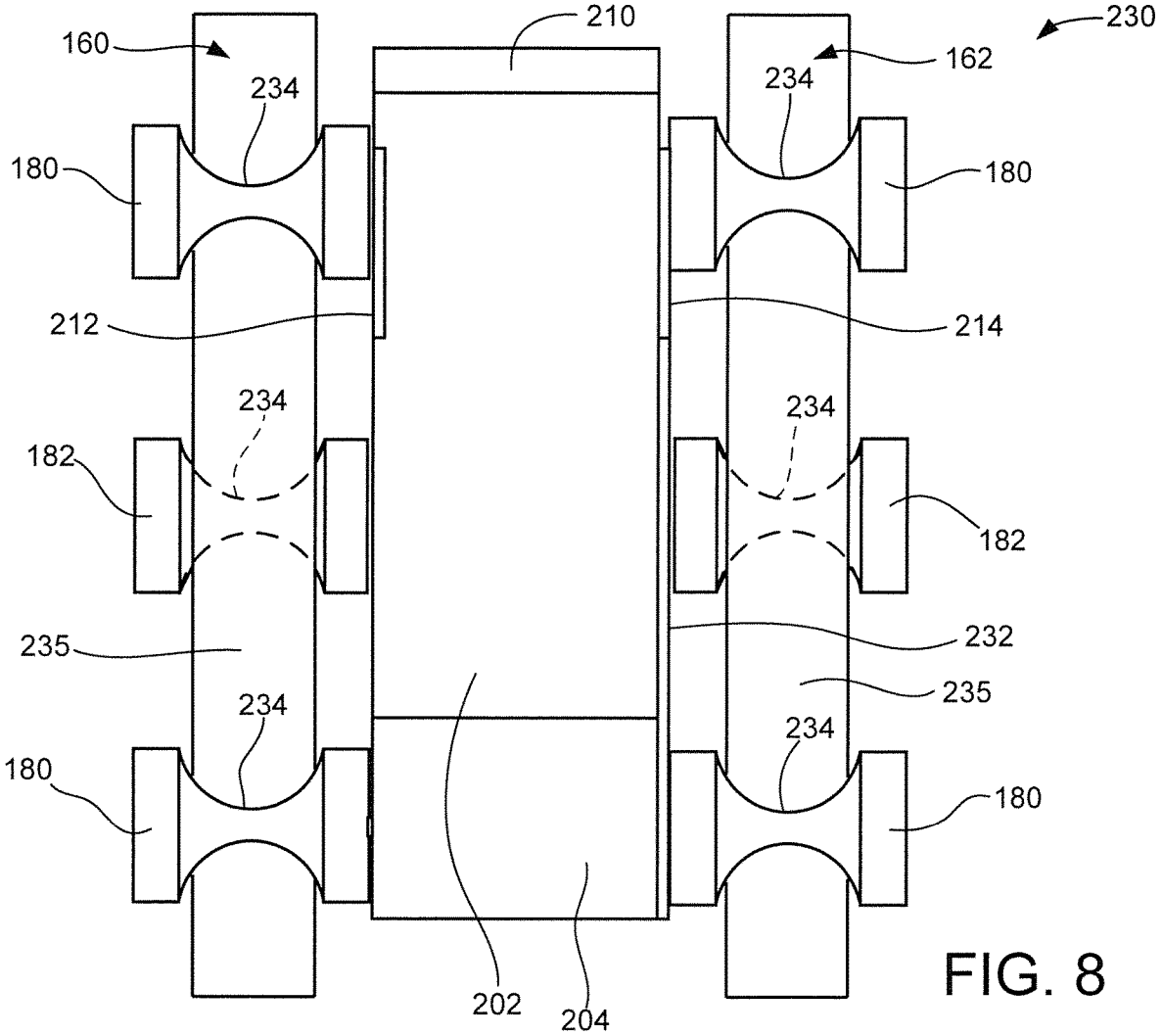
FIG. 8 is a top plan view of the foot plate portion in some embodiments.

FIG. 8 is a top down schematic simplified depiction of the foot plate 230 in some embodiments. It can be seen that the upper and lower rollers 180, 182 serve to capture the foot plate 230 while allowing efficient rolling movement along the rails (in this case, rails 160, 162). The relative placements of the rollers 180, 182 can be selected as desired; in some cases, the lower rollers 182 are placed so as to be behind the balls of the foot of the user to enhance stability and efficiency. This will be discussed in more detail below.

Figure 9A:
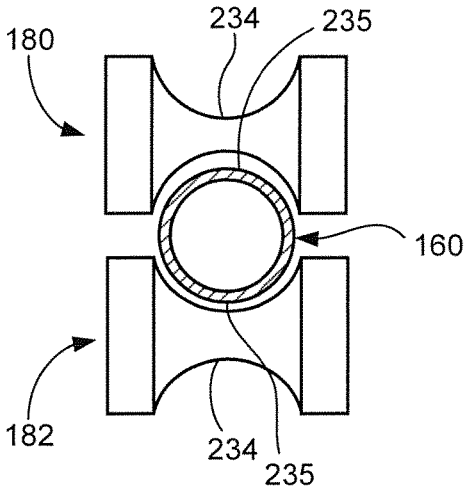
FIGS. 9A and 9B show different roller arrangements that can be used with the foot plate portion of FIG. 8.
Figure 9B:
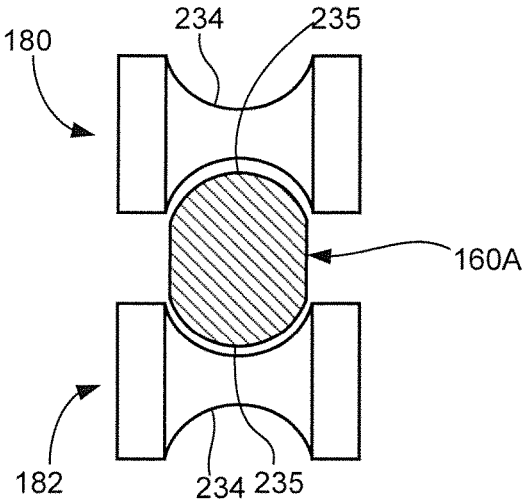

The rollers have concave inner surfaces 234, which enables the rollers to remain captured on the respective guide rails, which have corresponding upper and lower convex surfaces 235. FIG. 9A shows one embodiment where a cylindrical, hollow guide rail 160 is utilized. FIG. 9B shows another embodiment where an elongated, solid guide rail 160A is used. Other arrangements can be used, including arrangements that do not provide corresponding concave/convex surfaces at the rail/roller interface.

FIGS. 10A-10D show further arrangements of the various upper and lower rollers on each side of each foot plate assembly. As noted above, any number of respective rollers can be used, provided at least two upper rollers and at least one lower roller is included in a triangular pattern so that at least one lower roller is between and offset in a horizontal direction from the at least two upper rollers.

Figure 10A:
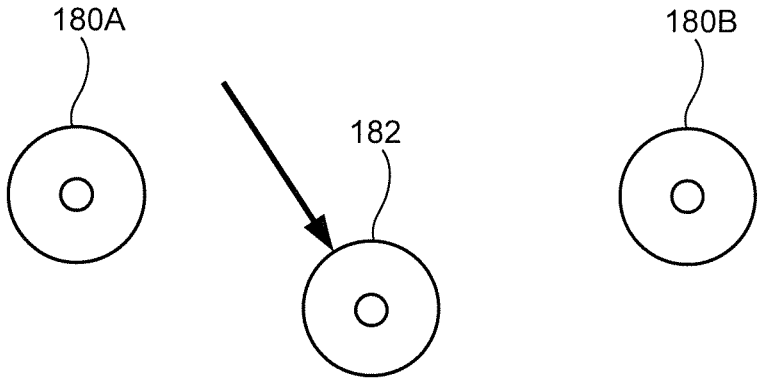
FIGS. 10A through 10D show different roller configurations in accordance with various alternative embodiments.

As shown in FIG. 10A, two upper rollers 180A, 180B and one lower roller 182 are provided on each side of the associated foot plate (not shown for clarity). This offset position of the lower roller 182 has been found to help stabilize the foot plate; the use of the wing 232 (FIG. 6) correctly aligns the foot of the user. Once properly aligned, it has been found that the front of the foot plate may tend to rise as force is applied by the ball of the user's foot (indicated by arrow). Hence, placing the at least one lower roller 182 in an offset relation, e.g., between the at least two upper rollers 180A-180B so as to not be vertically aligned therewith, helps to ensure maximum contact and efficiency of the rolling action of the foot plate.

Figure 10B:
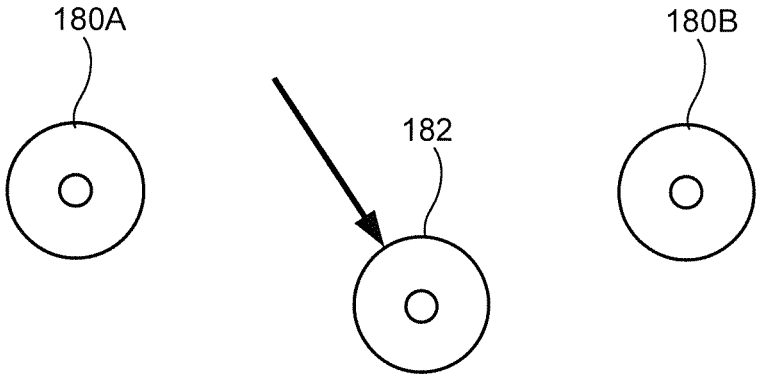

In some embodiments such as in FIG. 10A, the lower roller 182 is positioned to be closer to the front upper roller 180A as compared to the rear upper roller 180B. FIG. 10B shows another arrangement with the lower roller 182 closer to upper roller 180B. This arrangement still nominally aligns the lower roller 182 with the force applied by the ball of the user's foot.

Figure 10C:
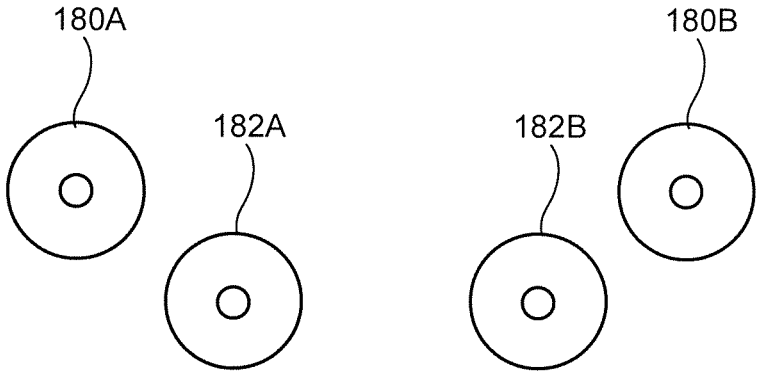
Figure 10D:
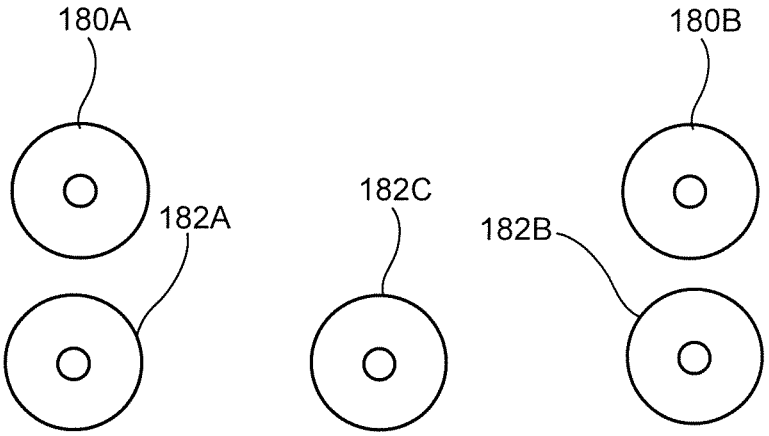

FIG. 10C shows the use of two lower rollers 182A and 182B that are inboard with respect to the upper rollers 180A and 180B. Each of the lower rollers 182A and 182B separately provides the aforementioned stabilizing triangular pattern with the upper rollers 180A and 180B. FIG. 10D shows two upper rollers 180A, 180B and two lower rollers 182B, 182B that are vertically aligned, along with an intermediary third lower roller 182C offset between the two upper rollers 180A, 18B to provide the aforementioned stabilizing triangular pattern with the upper rollers 180A and 180B.

Figure 11A:
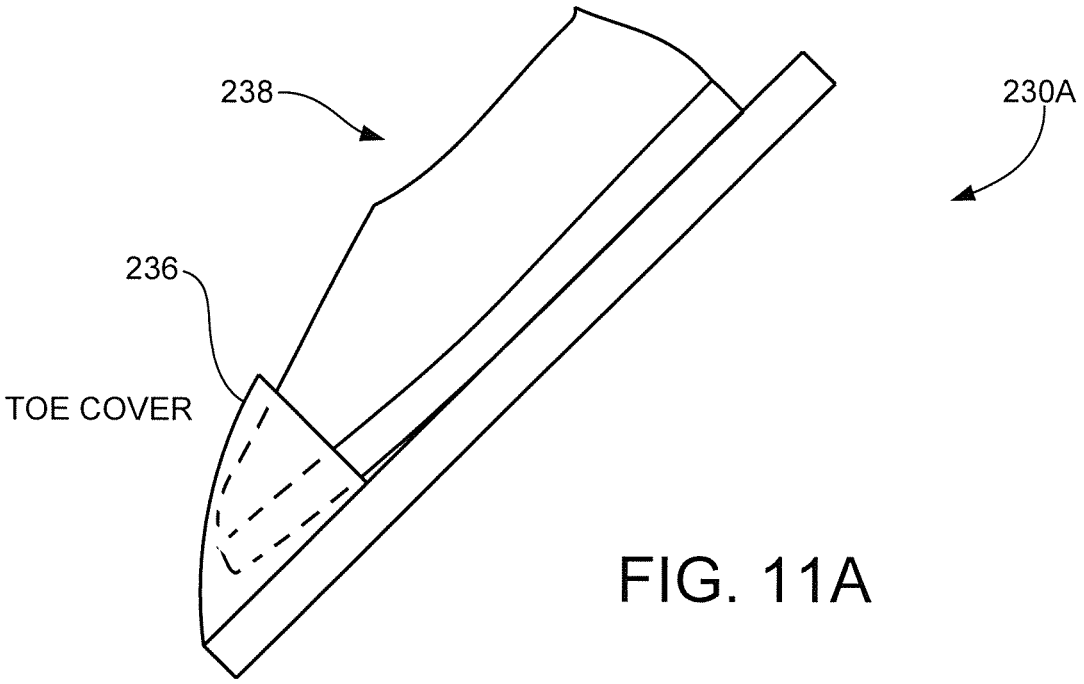
FIGS. 11A and 11B show additional features that can be incorporated into the foot plate portion in further embodiments.
Figure 11B:
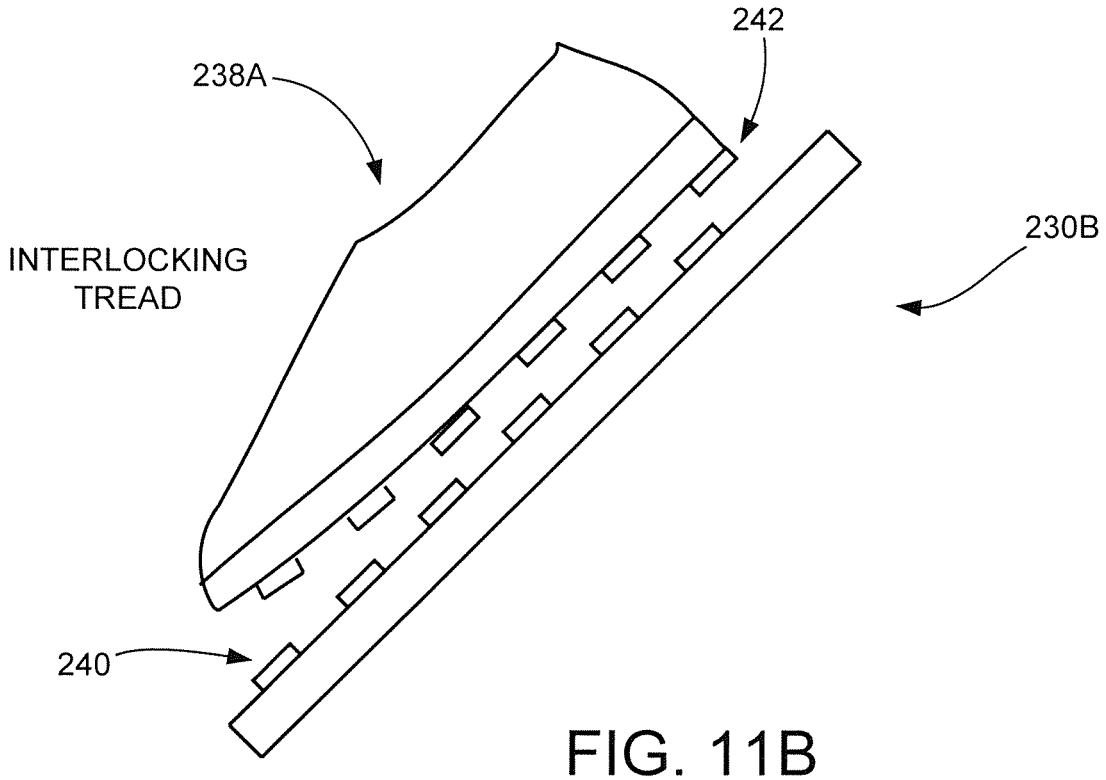

FIGS. 11A and 11B show further features that can be incorporated into the foot plate configurations discussed above. FIG. 11A shows an alternative foot plate 230A with a toe cover 236. The toe cover 236 is sized to receive a toe portion of a user's shoe 238. Other attachment mechanisms are contemplated, including straps or other retention members that extend over an intermediary or rear portion of the shoe, etc.

FIG. 11B shows another alternative foot plate 230B with an interlocking pattern of detents 240 sized and spaced to interlock with a corresponding pattern of detents 242 on a tread of a shoe 238A. In this way, enhanced adhesion of the shoe 238A to the plate 230B can be achieved.

It will now be appreciated that the various embodiments disclosed herein present a number of benefits over the existing art. The foot plate assemblies present contact surfaces at a suitable angle for supporting the soles of the shoes of the user. Retention members such as the toe plate and the side wing further ensure proper foot placement is maintained during use. The offset lower roller is positioned to offset the force applied by the ball of the foot of the user. The machine is durable, maneuverable and efficient in enabling users to carry out an effective exercise regimen in a safe and repeatable manner.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An exercise machine, comprising:

a rigid frame supporting a cushioned pad configured to support an upper torso portion of a user;

a pair of guide rails supported by and which extend longitudinally from the rigid frame in parallel spaced-apart relation; and a foot plate assembly configured for longitudinal movement along the pair of guide rails responsive to an exertion thereon by a leg of the user, the foot plate assembly comprising:

a foot support surface extending at a selected non-orthogonal angle with respect to the pair of guide rails, the foot support surface configured to support a sole of a foot of the user, the foot support surface having an inner side configured for alignment along an inner surface of the foot, an opposing outer side configured for alignment along an outer surface of the foot, a front edge configured for alignment adjacent a toe of the foot, and a back edge configured for alignment adjacent a heel of the foot;

a wing flange extending upwardly along the inner side of the foot support surface configured to contactingly maintain alignment of the heel of the foot during extension and retraction of the foot plate assembly along the pair of guide rails, the wing flange having a smallest, first height adjacent the front edge of the foot support surface, a larger, second height adjacent an intermediate portion of the inner side of the foot support surface, and a largest, third height adjacent the back edge of the foot support surface; and a plurality of rollers configured to rollingly engage the pair of guide rails, the plurality of rollers comprising at least a first set of three rollers arranged in a triangular pattern along the inner side of the foot support surface and at least a second set of three rollers arranged in a triangular pattern along the opposing outer side of the foot support surface, each of the first and second sets of three rollers comprising two upper rollers configured to extend above and roll along a top surface of the associated guide rail and a lower roller configured to extend below and roll along a bottom surface of the associated guide rail, the lower roller offset in a horizontal direction with respect to the associated two upper rollers.

2. The exercise machine of claim 1, further comprising a toe flange which extends upwardly from the front edge of the foot support surface configured to support the toe of the foot of the user.

3. The exercise machine of claim 1, wherein each of the pair of guide rails has an upper convex surface and a lower convex surface, wherein each of the upper rollers has a concave surface configured to contactingly engage the upper convex surface of the associated guide rail, and wherein each of the lower rollers has a concave surface configured to contactingly engage the lower convex surface of the associated guide rail.

4. The exercise machine of claim 1, wherein the selected non-orthogonal angle of the foot support surface extends at an angle of from nominally 120 degrees to nominally 160 degrees with respect to a horizontal plane along which the pair of guide rails extends, and wherein the smallest, first height, the larger, second height and the largest, third height of the wing flange extend in an orthogonal direction with respect to the foot support surface.

5. The exercise machine of claim 4, wherein the selected non-orthogonal angle is nominally 135 degrees.

6. The exercise machine of claim 1, further comprising a resistance member having a proximal end affixed to a front portion of the rigid frame and an opposing distal end affixed to a front portion of the foot plate assembly, the resistance member resisting movement of the foot plate assembly, by the leg of the user, along the pair of guide rails away from the front portion of the rigid frame.

7. The exercise machine of claim 6, wherein the resistance member comprises at least a selected one of a coiled spring or an elastomeric band.

8. The exercise machine of claim 1, further comprising a first ear flange that extends from the outer side of the foot support surface to support a first selected one of the two upper rollers of the first set of three rollers adjacent the outer side of the foot support surface and a second ear flange that extends from the wing flange to support a second selected one of the upper rollers of the second set of three rollers adjacent the inner side of the foot support surface, the second ear flange adjacent the smallest, first height adjacent the front edge of the foot support surface.

9. The exercise machine of claim 1, wherein the pair of guide rails is a first pair of guide rails characterized as a left side pair of guide rails and the foot plate assembly is a first foot plate assembly characterized as a left side foot plate assembly adapted to support a left foot of the user, wherein the exercise machine further comprises a second pair of guide rails nominally identical to the first pair of guide rails and characterized as a right side pair of guide rails and a second foot plate assembly nominally identical to the first foot plate assembly and characterized as a right side foot plate assembly adapted to support a right foot of the user, wherein the wing flange of the left side foot plate assembly is a left side wing flange, wherein the wing flange of the right side foot plate assembly is a right side wing flange, and wherein the left and right wing flanges are immediately adjacent each other along a longitudinal central axis of the exercise machine between the first and second pairs of guide rails.

10. The exercise machine of claim 1, wherein the cushioned pad comprises a chest pad adapted to contactingly support a sternum area of the upper torso portion of the user during use of the exercise machine, the exercise machine further comprising respective left and right shoulder pads on opposing sides of the chest pad to support respective left and right shoulders of the upper torso portion of the user during use of the exercise machine.

11. The exercise machine of claim 1, further comprising a knee pad that extends laterally adjacent a front portion of the foot plate assembly, the knee pad hinged to allow rotational movement of the knee pad with respect to the rigid frame to provide access, by the user, to the front portion of the foot plate assembly to install and remove a resistance member coupled between the foot plate assembly and the rigid frame.

12. An exercise machine of the type having a rigid frame, two sets of guide rails adapted to respectively support left and right foot plate assemblies, at least one cushioned pad to support an upper torso of a user, and at least one resistance member coupled to each of the left and right foot plate assemblies to resist movement as the user performs a leg extension exercise by alternatingly pressing against each of the left and right foot plate assemblies to independently advance and retract the left and right foot plate assemblies along the guide rails, each of the left and right foot plate assemblies comprising:

a foot support surface extending at a selected non-orthogonal angle with respect to the guide rails, the foot support surface configured to support a sole of a foot of the user, the foot support surface having an inner side configured for alignment along an inner surface of the foot, an opposing outer side configured for alignment along an outer surface of the foot, a front edge configured for alignment adjacent a toe of the foot, and a back edge configured for alignment adjacent a heel of the foot;

a wing flange extending upwardly along the inner side of the foot support surface configured to maintain alignment of the foot during extension and retraction of the associated foot plate assembly along the associated set of guide rails; and a plurality of rollers configured to rollingly engage the associated set of guide rails, the plurality of rollers comprising at least a first set of three rollers arranged in a triangular pattern along the inner side of the foot support surface and at least a second set of three rollers arranged in a triangular pattern along the outer side of the foot support surface, each of the first and second sets of three rollers comprising two upper rollers configured to extend above and roll along a top surface of the associated guide rail and a lower roller configured to extend below and roll along a bottom surface of the associated guide rail, the lower roller offset in a horizontal direction with respect to the associated two upper rollers, each guide rail in the associated set of guide rails further having an upper convex surface and a lower convex surface, each of the first and second sets of three rollers further having an associated concave surface to contactingly engage the upper convex surfaces or lower convex surfaces, respectively, of the associated set of guide rails.

13. The exercise machine of claim 12, further comprising a toe flange which extends upwardly from the front edge of the foot support surface configured to support the toe of the foot of the user.

14. The exercise machine of claim 12, wherein the lower roller is configured to be positioned to be nominally aligned with a ball of the foot of the user as the user presses against the foot support surface.

15. The exercise machine of claim 12, wherein each of the left and right foot plate assemblies further comprising a side panel which depends downwardly in a direction toward the associated set of guide rails at nominally 90 degrees with respect to the foot support surface so that there is no obstruction for the user to slide the associated foot onto the associated foot plate assembly from an outboard position opposite the associated wing flange.

16. The exercise machine of claim 12, wherein the wing flange of each of the left and right foot plate assemblies continuously increases in height from a shortest vertical extent adjacent the front edge of the foot support surface to a greatest vertical extent adjacent the back edge of the foot support surface.

17. An exercise machine adapted to enable a user to perform a leg extension exercise using both left and right legs of the user moving independently against a resistive force along a nominally horizontal plane, the exercise machine comprising:

a rigid frame configured to be supported on a horizontal base surface, the rigid frame comprising a laterally extending base member, first and second posts vertically extending from the laterally extending base member, a laterally extending forward cross bar coupled to the laterally extending base member by a longitudinally extending t-bar member, a laterally extending intermediate cross bar member adjoining the first and second posts above the laterally extending base member, and a rear cross bar parallel to the laterally extending base member and elevationally aligned with the intermediate cross bar member;

first and second shoulder pad cushions adapted to support an upper torso of the user, the first shoulder pad cushion affixed to the first post and the second shoulder pad cushion affixed to the second post;

first and second pairs of guide rails extending longitudinally in spaced apart parallel relation between the laterally extending intermediate cross bar member and the rear cross bar member, the first pair of guide rails characterized as a left side pair of guide rails, the second pair of guide rails characterized as a right side pair of guide rails;

a first foot plate assembly characterized as a left side foot plate assembly coupled to the left side pair of guide rails, the left side foot plate assembly comprising:

a left foot support surface extending at a selected non-orthogonal angle with respect to the left side pair of guide rails, the left foot support surface configured to support a sole of the left foot of the user, the left foot support surface having an inner side configured for alignment along an inner surface of the left foot, an opposing outer side configured for alignment along an outer surface of the left foot, a front edge configured for alignment adjacent a toe of the left foot, and a back edge configured for alignment adjacent a heel of the left foot;

a left side wing flange extending upwardly along the inner side of the left foot support surface configured to maintain alignment of the left foot during extension and retraction of the left foot plate assembly along the left side pair of guide rails; and a first plurality of rollers configured to rollingly engage the left side pair of guide rails, the first plurality of rollers comprising at least a first set of three rollers arranged in a triangular pattern along the inner side of the left foot support surface and at least a second set of three rollers arranged in a triangular pattern along the outer side of the left foot support surface, each of the first and second sets of three rollers comprising two upper rollers configured to extend above and roll along a top surface of the associated guide rail and a lower roller configured to extend below and roll along a bottom surface of the associated guide rail, the lower roller offset in a horizontal direction with respect to the associated two upper rollers;

a second foot plate assembly characterized as a right side foot plate assembly coupled to the right side pair of guide rails, the right side foot plate assembly comprising:

a right foot support surface extending at the selected non-orthogonal angle with respect to the right side pair of guide rails, the right foot support surface configured to support a sole of the right foot of the user, the right foot support surface having an inner side configured for alignment along an inner surface of the right foot, an opposing outer side configured for alignment along an outer surface of the right foot, a front edge configured for alignment adjacent a toe of the right foot, and a back edge configured for alignment adjacent a heel of the right foot;

a right side wing flange extending upwardly along the inner side of the right foot support surface configured to maintain alignment of the right foot during extension and retraction of the right foot plate assembly along the right side pair of guide rails; and a second plurality of rollers configured to rollingly engage the right side pair of guide rails, the second plurality of rollers comprising at least a first set of three rollers arranged in a triangular pattern along the inner side of the right foot support surface and at least a second set of three rollers arranged in a triangular pattern along the outer side of the right foot support surface, each of the first and second sets of three rollers of the second plurality of rollers comprising two upper rollers configured to extend above and roll along a top surface of the associated guide rail and a lower roller configured to extend below and roll along a bottom surface of the associated guide rail, the lower roller offset in a horizontal direction with respect to the associated two upper rollers;

a first resistance member connecting the laterally extending forward cross bar to the first foot plate assembly; and a second resistance member connecting the laterally extending forward cross bar to the second foot plate assembly;

wherein the left side wing flange is immediately adjacent to and in facing relation away from the right side wing flange;

wherein each of the guide rails has an upper convex surface and a lower convex surface;

wherein each of the upper rollers has a concave surface configured to contactingly engage the upper convex surface of the associated guide rail; and wherein each of the lower rollers has a concave surface configured to contactingly engage the lower convex surface of the associated guide rail.

18. The exercise machine of claim 17, wherein the selected non-orthogonal angle extends at an angle of from nominally 120 degrees to nominally 160 degrees with respect to the nominally horizontal plane along which each of the first and second pairs of guide rails extends.

19. The exercise machine of claim 17, further comprising at least one wheel mounted to the rigid frame to facilitate movement of the exercise machine along the horizontal base surface.

20. An exercise machine, comprising:

a rigid frame supporting a cushioned torso pad configured to support an upper torso portion of a user;

a pair of guide rails supported by and which extend longitudinally from the rigid frame in parallel spaced-apart relation;

a foot plate assembly configured for longitudinal movement along the pair of guide rails responsive to an exertion thereon by a leg of the user, the foot plate assembly comprising:

a foot support surface extending at a selected non-orthogonal angle with respect to the pair of guide rails, the foot support surface configured to support a sole of a foot of the user, the foot support surface having an inner side configured for alignment along an inner surface of the foot, an opposing outer side configured for alignment along an outer surface of the foot, a front edge configured for alignment adjacent a toe of the foot, and a back edge configured for alignment adjacent a heel of the foot;

a wing flange extending upwardly along the inner side of the foot support surface configured to maintain alignment of the foot during extension and retraction of the foot plate assembly along the pair of guide rails; and a plurality of rollers configured to rollingly engage the pair of guide rails, the plurality of rollers comprising at least a first set of three rollers arranged in a triangular pattern along the inner side of the foot support surface and at least a second set of three rollers arranged in a triangular pattern along the outer side of the foot support surface, each of the first and second sets of three rollers comprising two upper rollers configured to extend above and roll along a top surface of the associated guide rail and a lower roller configured to extend below and roll along a bottom surface of the associated guide rail, the lower roller offset in a horizontal direction with respect to the associated two upper rollers; and a knee pad that extends laterally adjacent a front portion of the foot plate assembly, the knee pad hinged to allow rotational movement of the knee pad with respect to the rigid frame to provide access, by the user, to the front portion of the foot plate assembly to install and remove a resistance member coupled between the foot plate assembly and the rigid frame.

21. The exercise machine of claim 20, wherein each of the pair of guide rails has an upper convex surface and a lower convex surface, wherein each of the upper rollers has a concave surface configured to contactingly engage the upper convex surface of the associated guide rail, and wherein each of the lower rollers has a concave surface configured to contactingly engage the lower convex surface of the associated guide rail.

22. The exercise machine of claim 20, wherein the wing flange is further configured to contactingly align the heel of the foot during extension and retraction of the foot plate assembly along the pair of guide rails by having a smallest, first height adjacent the front edge of the foot support surface, a larger, second height adjacent an intermediate portion of the inner side of the foot support surface, and a largest, third height adjacent the back edge of the foot support surface.

23. The exercise machine of claim 22, wherein the wing flange continuously increases in height from the smallest, first height to the largest, third height along the inner side of the foot support surface.

* * * * *